US005915458A

United States Patent [19]

Pavlicevic et al.

[11] Patent Number: 5,915,458

[45] Date of Patent: Jun. 29, 1999

[54] METHOD TO OBTAIN TRANSVERSE VIBRATIONS OF THE WALLS OF THE CRYSTALLISER IN AN INGOT MOULD BY MEANS OF A PULSATION IN THE COOLING FLUID

[75] Inventors: Milorad Pavlicevic; Nuredin Kapaj, both of Udine; Alfredo Poloni, Fogliano Di Redipuglia; Andrea Codutti, Moruzzo, all of Italy

[73] Assignee: Danieli & C. Officine Meccaniche SpA, Buttrio, Italy

[21] Appl. No.: 08/848,181

[22] Filed: Apr. 29, 1997

[30] Foreign Application Priority Data

Apr. 30, 1996 [IT] Italy ..... UD96A0067
Sep. 25, 1996 [IT] Italy ..... UD96A0179

[51] Int. Cl.[6] ..... B22D 11/04

[52] U.S. Cl. ..... 164/478; 164/416

[58] Field of Search ..... 164/478, 416

[56] References Cited

FOREIGN PATENT DOCUMENTS 0686445 12/1995 European Pat. Off. .
19547779 6/1996 Germany .
95/03904 2/1995 WIPO .
95/05910 3/1995 WIPO .
96/11077 4/1996 WIPO .

OTHER PUBLICATIONS

Patent Abstracts of Japan vol. 8, No. 230 (M–333), Oct. 23, 1984 & JP–A–59 110451 (Hitachi Seisakusho KK).

*Primary Examiner*—Kuang Y. Lin
*Attorney, Agent, or Firm*—Antonelli, Terry, Stout & Kraus, LLP

[57] ABSTRACT

Method to obtain transverse vibrations of the walls (111) of the crystalliser (11) in an ingot mould (10), by a pulsation in the cooling liquid, the ingot mould (10) possibly having one or more peripheral areas (13*a*, 13*b*), disposed lengthwise, wherein the cooling liquid circulates around the sidewalls (111) of the crystalliser (11), the cooling circuit comprising a transit channel (16) directly in contact with one or more sidewalls (111) and at least a pump, a delivery pipe and a discharge pipe connected with a discharge side (21), the cooling fluid being made to circulate the pump around the sidewalls (111) of the crystalliser (11), in cooperation with at least one portion of the sidewall (111), the pressure of the cooling liquid in transit being of the pulsation type, the pulsation in the pressure being functional to the desired elastic transverse vibration induced on the portion of the sidewall (111).

6 Claims, 2 Drawing Sheets

METHOD TO OBTAIN TRANSVERSE VIBRATIONS OF THE WALLS OF THE CRYSTALLISER IN AN INGOT MOULD BY MEANS OF A PULSATION IN THE COOLING FLUID

BACKGROUND OF THE INVENTION

This invention concerns a method to obtain transverse vibrations in the walls of a crystaliser in an ingot mould by means of a pulsation in the cooling fluid.

The invention is applied in the field of continuous casting of billets, blooms or slabs of any type or section, in order to reduce friction between the cast product and the walls of the crystalliser, thus allowing an increase in the speed of casting and reducing the risk of breakout in the skin of the product as it is formed.

The problems connected with trying to reduce the force needed to extract the cast product from inside the crystalliser are well known to the state of the art.

It is known in fact that, as the skin solidifies, it tends to stick to the walls, at least in the upper part of the crystalliser, generating considerable friction in the extraction stage.

To facilitate the detachment of the skin from the wall, the state of the art covers the method of generating longitudinal, mechanical oscillations on the ingot mould which facilitate the extraction of the cast product and allow the casting speed to be increased and the surface quality of the product leaving the crystalliser to be improved.

It is also known that in the lower part of the crystalliser, the skin which has by now solidified tends to become detached from the walls, thus creating an air gap which causes a reduction in the heat exchange between the cooled wall and the solidified skin, and therefore a reduction in the heat flow removed from the molten metal through the wall of the crystalliser.

The present applicant, in the European patent application EP-A-0686445, described the use of a crystalliser with thin walls associated with a method to control the deformations of said walls; that invention uses the regulation of the pressure of the cooling fluid which runs in the transit channel adjacent to the walls so as to compensate for the different shrinkage of the skin of the cast product through the crystalliser according to the type of steel and the casting speed.

According to that document, the walls of the crystalliser assume an elastic state in relation to the different pressures of the cooling fluid which runs outside them, in such a way as to cancel, in the first portion of the crystalliser, the negative taper induced by the heat field and, in the lower part of the crystalliser, in such a way as to minimise the air gap which is created between the solidified skin and the walls.

These pressures are calculated to obtain the desired deformation of the walls and are maintained substantially constant until the casting parameters, particularly the type of steel and the casting speed, are changed.

The variable pressure of the cooling liquid is therefore used to deform the sidewalls, not to make them vibrate elastically.

DE-A-19.547.779 discloses a device which uses the pulsation of the pressure of the cooling liquid delivered to a support device, (14, 19, 20) which has a yielding effect to obtain vertical, or in any case, longitudinal oscillations, in a crystalliser.

The support device is identified as a bellows device (FIG. 1), a fluid cylinder (FIG. 2) or a pair of disk springs (FIG. 3).

The pulsation in the pressure of the cooling liquid causes a vertical oscillation of the support device (14, 19, 20) which causes a corresponding vertical oscillation of the crystalliser (2) associated with the support device (14, 19, 20).

This device replaces, or cooperates with, the conventional mechanical means of vertical oscillation of the crystalliser so as to assist the descent of the molten metal and detach the solidifying skin from the inner sidewalls of the crystalliser.

In the device as disclosed by DE'779, the pulsation in the pressure of the cooling liquid does not act directly on the sidewalls of the crystalliser in order to cause an elastic vibration thereof in a tranverse direction to that of the casting, it acts by means of the support devices (14, 19, 20) with a yielding effect so as to induce vertical oscillations on the crystalliser (2).

SUMMARY OF THE INVENTION

The present applicants therefore set themselves the aim of obtaining a solution which could be applied substantially to any type of crystalliser, which would give the advantage of reducing the force of extraction required, the advantage of reducing the sticking of the skin to the wall, the advantage of reducing the friction between the walls of the crystalliser and the cast product, the advantage of improving the surface quality and to achieve further advantages.

To this aim, the present applicants have designed, tested and embodied the following invention.

The purpose of the invention is to provide a method to obtain vibrations in the walls of the crystalliser, in a transverse direction to that of casting, by means of desired and controlled pulsations in the cooling fluid; this method makes it possible to reduce the friction between the crystalliser wall and the cast product and consequently to reduce the force required to extract the cast product from inside the crystalliser.

A further purpose of the invention is to obtain an improvement in the surface quality of the cast product thus obtained.

The invention assists the controlled detachment of the skin as it is forming, from the inner wall of the crystalliser.

A variant of the invention assists the metal to become detached particularly from the walls in the upper part of the crystalliser, thus reducing the friction due to sticking, and reduces the risk of deterioration in the surface of the cast product due to its rubbing against the wall.

According to the invention, the system to feed the cooling fluid for the walls of the crystalliser is regulated in such a way as to generate forced and controlled elastic vibrations of the walls, in a transverse direction to that of casting; the vibrations are induced by the controlled and commanded cyclical variation, or pulsation, of the pressure at which the cooling fluid, which circulates in direct contact with the sidewalls, is fed.

These transverse vibrations are advantageously of a small amplitude so as to assist the continuous detachment of the skin of the cast product from the wall of the crystalliser as soon as this phenomenon occurs.

The cyclical pulsation of the pressure of the cooling fluid causes a correlated transverse cyclical vibration of the walls of the crystalliser with respect to the mass of molten metal present between the walls.

This cyclical vibration assists the detachment of the molten metal from the wall, particularly in the first portion of the crystalliser, reducing the relative friction and therefore making it possible to reduce the force needed to extract the cast product.

The cyclical variation, or pulsation, of the pressure can be achieved in various ways: either by acting on partial or total interceptors which act, for example, on the outlet pipe of the cooling fluid; or by means of a significant variation in the resistance curve of the circuit, which causes in the pump significant variations of the volumetric pressure in the circuit itself; or by staggering the various pistons of the volumetric pump.

This variation in the pressure of the cooling fluid also causes an increase in the coefficient of heat exchange between the crystalliser wall and the cooling liquid itself.

According to a preferred, non-restrictive embodiment of the invention, the cooling circuit is sub-divided into at least two distinct parts along the longitudinal extension of the crystalliser; this makes it possible to apply parameters of differentiated oscillation with relation to the different sticking conditions and therefore the different friction values which are generated between the skin and the walls inside the crystalliser.

According to a variant, at least one longitudinal part is sub-divided into two or more portions, each one associated with its own cooling circuit where the parameters of the pressure of the fluid which can be regulated individually.

According to a preferred embodiment of the invention, the cooling circuit used in the method according to the invention comprises a volumetric feed pump and a regulating valve with a variable aperture, placed along the circuit downstream of the crystalliser.

The use of a volumetric pump makes it possible to obtain a much more marked correlation between the variation in the pressure of the cooling liquid and the variations in the aperture of the regulating valve.

In fact the characteristic curve of a volumetric pump (Q-H), Q represents the volume flow rate and H represents the pump head, is substantially vertical, and so a significant variation in the gradient of the circuit resistance curve, which is determined by acting on the aperture of the regulating valve, causes considerable variations in pressure throughout the whole circuit without modifying the flow of water.

According to a variant, the pulsation of the pressure of the cooling liquid is obtained by staggering the pistons of the volumetric pump, thus exploiting its intrinsic characteristics, without the need to include regulating valves downstream.

According to the invention, in order to obtain the most significant results in terms of the maximum frequency of transverse vibration of the crystalliser walls with the variation of the pressure of the cooling fluid, advantageously the volume of water within the transit channel adjacent to the walls will be limited.

BRIEF DESCRIPTION OF THE DRAWINGS

The attached figures are given as a non-restrictive example and show a preferred embodiment of the invention as follows.

DETAILED DESCRIPTION OF THE PREFERRED EMBODIMENT

Figure 1:
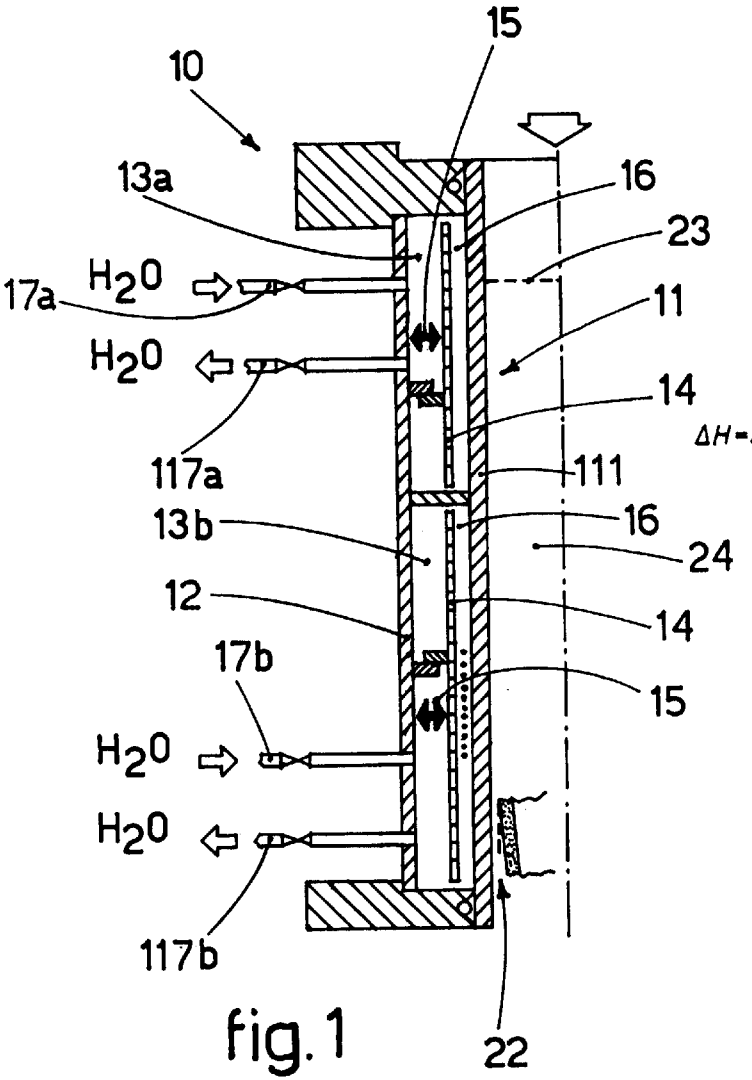
FIG. 1 shows in diagrammatic and partial form a longitudinal section of an ingot mould where the method to regulate the pressure of the cooling fluid according to the invention is applied.

The ingot mould 10 shown in FIG. 1 comprises a crystalliser 11, with sidewalls 111, advantageously but not exclusively of the type with thin walls, with a thickness of between 4 and 15 mm, advantageously between 4 and 10 mm.

The ingot mould 10 has containing walls 12 arranged outside the crystalliser 11 and defining with its sidewalls 111 the chamber inside which the cooling fluid circulates, directly in contact with the outer face of the sidewalls 111.

Figure 2:
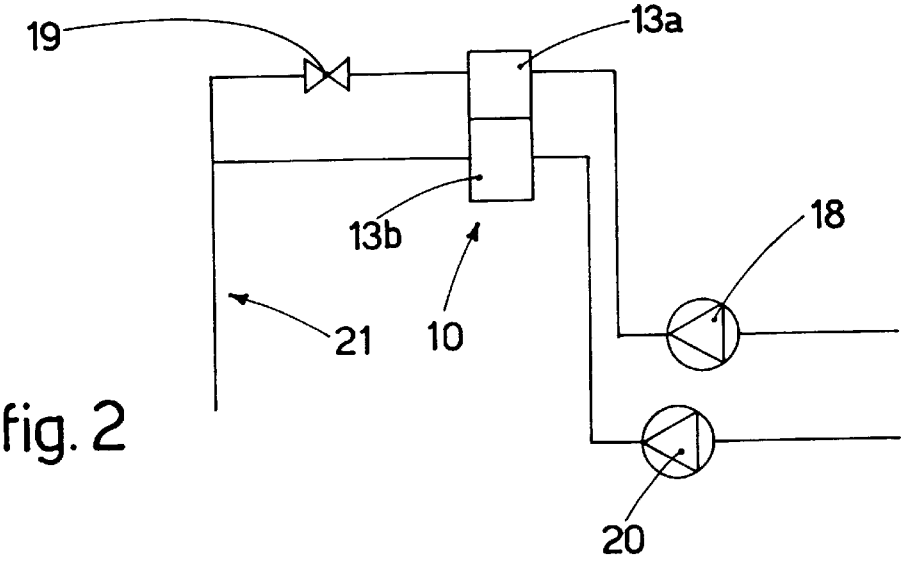
FIG. 2 shows in diagram form the cooling circuit which uses the method according to the invention

In the case shown in FIGS. 1 and 2, the cooling chamber is sub-divided into two parts placed in sequence and lengthwise, respectively 13*a* and 13*b*, to which the cooling liquid is fed separately and independently.

According to further variants which are not shown here, the cooling chamber can be sub-divided into three or more parts located lengthwise and in sequence.

The spirit of the invention also provides that the cooling chamber, also inside one of its longitudinal parts, may be divided into one or more portions according to the characteristics relating to the detachment of the skin and the control thereof that it is desired to obtain on the sidewall 111 of the crystalliser 11.

In this case, the cooling chambers 13*a* and 13*b* have a respective intermediate wall 14 which forms, with the relative sidewall of the crystalliser 11, a transit channel 16, of extremely limited width, for the cooling fluid.

The transit channel 16 may act on one or more sidewalls 111 of the crystalliser 11.

The intermediate wall 14 can be movable in the direction of the arrow 15 to form a transit channel 16 with a variable section.

Each cooling chamber 13*a* and 13*b* has respective inlets and outlets for the cooling fluid, respectively 17*a*,117*a* and 17*b*,117*b*.

According to the invention, the cooling circuit comprises at least one pump of the volumetric type 18 which feeds the cooling fluid, in the case of FIG. 2, to the cooling chamber 13*a* associated with the upper portion of the crystalliser 11.

On the cooling circuit of the upper portion, corresponding with the discharge side 21, there is a valve 19 with an aperture which can be opened in a controlled way; the valve 19 can be activated by means of an elaboration and control unit, not illustrated here.

By using a valve 19 with a variable aperture on the discharge side of the cooling circuit, it is possible to achieve a controlled, cyclical variation, or pulsation, according to defined parameters, of the pressure of the cooling fluid which is circulating in the relative cooling chamber and particularly in the transit channel 16 and in contact with the outer face of the sidewalls 111 of the crystalliser 11.

The cyclical variation of the pressure, or pulsation, causes a corresponding cyclical vibration, in a transverse direction to that of the casting, of the walls 111 of the crystalliser 11 adjacent to the transit channel 16.

The transverse cyclical vibration assists the detachment of the metal from the wall, particularly in the upper portion of the crystalliser, where the phenomenon of sticking occurs, starting from the meniscus line 23, between the metal 24 which is still in a liquid state and the inner face of the wall 111 of the crystalliser 11.

By using a volumetric pump 18 instead of a conventional centrifugal pump 20 it is possible to obtain high variations in the pressure and modify the circuit resistance curve by means of the valve 19.

Figure 3:
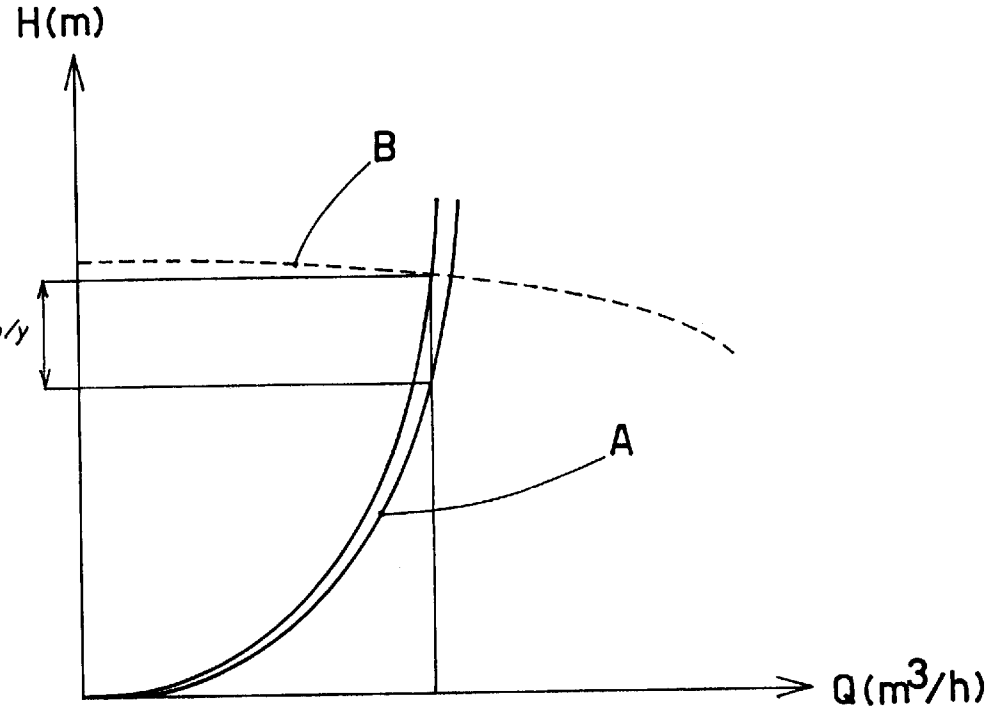
FIG. 3 shows a graph of the characteristic correlation curves of two different types of feed pumps.

As can be seen from FIG. 3, a volumetric pump gives a characteristic curve H-Q, indicated by A, which has a substantially vertical trend.

It can be seen from the graph how a variation in the angle of the parabola of the cooling circuit resistance causes a much more marked displacement of the functioning point, with a considerable variation in the pressure, with respect to the case of a centrifugal pump, which has a characteristic curve, indicated by B, with a substantially horizontal trend.

In the solution shown in FIG. 2, the modified cooling circuit with a cyclical regulation of the pressure affects the upper part of the ingot mould 10, whereas the lower part is associated with a conventional cooling circuit with its relative centrifugal pump 20.

Figure 4:
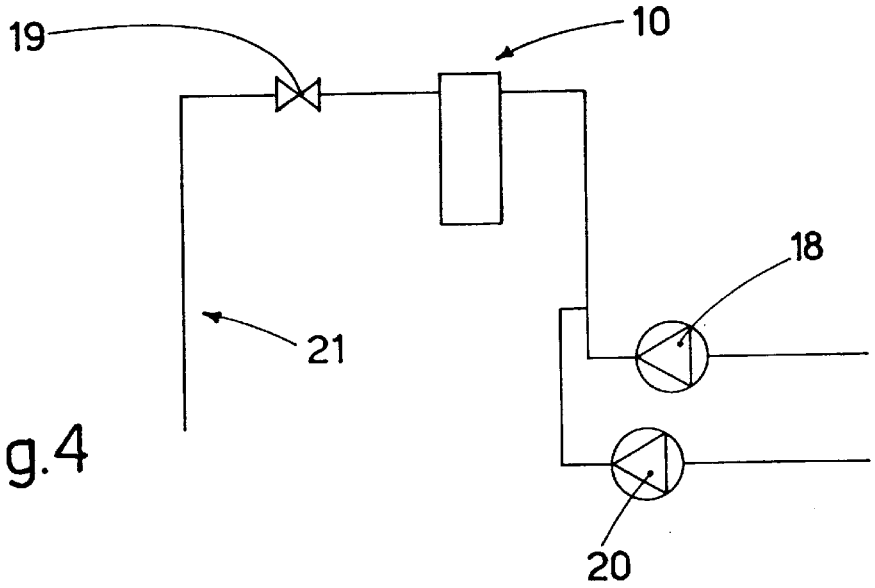
FIG. 4 shows a variant of FIG. 2.

In the variant shown in FIG. 4, the ingot mould 10 cooperates with a single cooling circuit of a type having a volumetric pump 18 and a valve 19 with a variable aperture, where the cyclical regulation of the pressure is univocal throughout the longitudinal extension of the ingot mould 10.

In this case, there is a second pump, of the volumetric or centrifugal type, which intervenes in emergency situations or as an auxiliary to the main pump 18.

Figure 5:
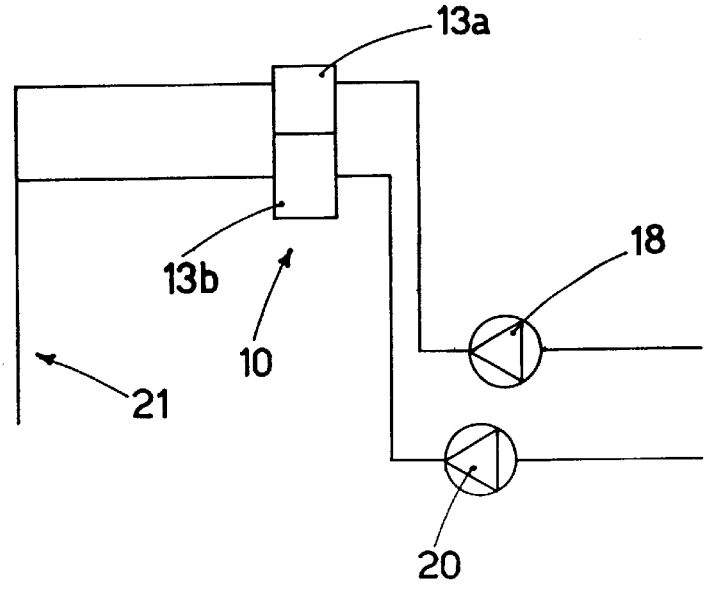
FIG. 5 shows a further variant of FIG. 2.

In the further variant shown in FIG. 5, the pulsation in the water pressure is caused by the staggering of the various pistons of the volumetric pump, thus exploiting the intrinsic characteristics of this type of pump.

In this case, there is no need to use a valve downstream, such as the valve 19 shown in FIG. 2.

We claim:

1. Method to obtain transverse vibrations of walls of a crystalliser of an ingot mould by means of a pulsation in a cooling fluid, comprising circulating the cooling fluid around sidewalls of the crystalliser through a cooling circuit comprising a transit channel directly in contact with one or more sidewalls and at a least pump, a delivery pipe and a discharge pipe connected with a discharge side, the cooling fluid being made to circulate, by the pump, around the sidewalls of the crystalliser and, in cooperation with at least one portion of the sidewalls, pulsating a pressure of the cooling fluid in transit, the pulsation of the pressure being functional to a desired elastic transverse vibration induced on the at least one portion of the sidewall.

2. Method as in claim 1, in which the frequency of the pulsation in the pressure of the cooling fluid is regulated.

3. Method as in claim 2, in which the frequency of the pulsation in the pressure of the cooling fluid is varied between the at least one portion of the sidewall and another portion.

4. Method as in claim 2, in which the frequency of the pulsation in the pressure is varied between one sidewall and another sidewall.

5. Method as in claim 1, in which the circulation of the cooling fluid is achieved with a feeding pump of the volumetric type.

6. Method as in claim 1, in which the pulsation of the pressure is obtained by acting on a value a variable aperture disposed at least on the discharge side.

* * * * *